US005967423A

United States Patent [19]

Sumida et al.

[11] Patent Number: 5,967,423

[45] Date of Patent: Oct. 19, 1999

[54] FUEL INJECTION VALVE

[75] Inventors: Mamoru Sumida; Norihisa Fukutomi; Keita Hosoyama, all of Toyko, Japan

[73] Assignee: Mitsubishi Denki Kabushiki Kaisha, Tokyo, Japan

[21] Appl. No.: 08/962,911

[22] Filed: Oct. 31, 1997

[51] Int. Cl.[6] ..... F02M 61/00

[52] U.S. Cl. ..... 239/533.12; 239/585.1

[58] Field of Search ..... 239/463, 487, 239/533.2, 533.9, 533.11, 533.12, 585.1, 585.4, 585.5; 251/129.21

[56] References Cited

U.S. PATENT DOCUMENTS

| | | | |
|---|---|---|---|
| 4,382,554 | 5/1983 | Hofmann | 239/533.9 |
| 4,407,457 | 10/1983 | Seifert | 239/533.12 |
| 4,650,121 | 3/1987 | Augustin | 239/464 |
| 4,967,959 | 11/1990 | Wieczorek | 239/104 |
| 4,971,254 | 11/1990 | Daly et al. | 239/585.1 |
| 5,242,118 | 9/1993 | Schmidt et al. | 239/533.4 |
| 5,494,225 | 2/1996 | Nally et al. | 239/585.5 |
| 5,570,841 | 11/1996 | Pace et al. | 239/585.1 |
| 5,685,485 | 11/1997 | Mock et al. | 239/102.2 |
| 5,699,963 | 12/1997 | Ueda | 239/88 |
| 5,765,750 | 6/1998 | Pace et al. | 239/5 |

FOREIGN PATENT DOCUMENTS

| | | |
|---|---|---|
| 196 16 806 | 4/1997 | Germany . |
| 195 45 333 | 6/1997 | Germany . |
| 4-77150 | 12/1992 | Japan . |

*Primary Examiner*—Andres Kashnikow
*Assistant Examiner*—Lisa Ann Douglas
*Attorney, Agent, or Firm*—Sughrue, Mion, Zinn, Macpeak & Seas, PLLC

[57] ABSTRACT

An improved fuel injection valve for improving the flow of fuel includes a vortex forming member and a needle valve having a planar surface on its leading end. A valve seat has a fuel injection nozzle formed therein and the needle valve opens and closes the fuel injection nozzle by engaging and disengaging with the valve seat. The vortex forming member provides a vortex motion to the fuel entering the fuel injection nozzle, upstream of a seat portion. The flat portion reduces the amount of surface area in which particles may adhere, thus preventing particles from adhering to the needle valve and reducing interference with the flow of fuel.

5 Claims, 10 Drawing Sheets

FIGURE 9

RELATIONSHIP AMONG CAVITY COEFFICIENT k
AND CHARACTERISTICS K, $C_0$, $\alpha_0$

| k | K | $C_0$ | $\alpha_0°$ | k | K | $C_0$ | $\alpha_0°$ |
|---|---|---|---|---|---|---|---|
| 1.00 | 0.0000 | 0.0000 | 180.0 | 0.50 | 1.0736 | 0.5368 | 60.0 |
| 0.98 | 0.0054 | 0.0053 | 157.0 | 0.48 | 1.1730 | 0.5631 | 57.4 |
| 0.96 | 0.0155 | 0.0149 | 147.5 | 0.46 | 1.2807 | 0.5891 | 54.8 |
| 0.94 | 0.0289 | 0.0271 | 140.1 | 0.44 | 1.3977 | 0.6150 | 52.2 |
| 0.92 | 0.0451 | 0.0415 | 133.8 | 0.42 | 1.5252 | 0.6406 | 49.7 |
| 0.90 | 0.0639 | 0.0575 | 128.3 | 0.40 | 1.6646 | 0.6658 | 47.2 |
| 0.88 | 0.0853 | 0.0757 | 123.3 | 0.38 | 1.8176 | 0.6907 | 44.7 |
| 0.86 | 0.1091 | 0.0938 | 118.6 | 0.36 | 1.9864 | 0.7151 | 42.2 |
| 0.84 | 0.1354 | 0.1137 | 114.5 | 0.34 | 2.174 | 0.7391 | 39.7 |
| 0.82 | 0.1642 | 0.1346 | 110.2 | 0.32 | 2.383 | 0.7625 | 37.3 |
| 0.80 | 0.1955 | 0.1564 | 106.3 | 0.30 | 2.618 | 0.7853 | 34.9 |
| 0.78 | 0.2294 | 0.1790 | 102.5 | 0.28 | 2.884 | 0.8074 | 32.5 |
| 0.76 | 0.2661 | 0.2022 | 98.9 | 0.26 | 3.188 | 0.8289 | 30.1 |
| 0.74 | 0.3055 | 0.2260 | 95.5 | 0.24 | 3.540 | 0.8496 | 27.8 |
| 0.72 | 0.3478 | 0.2504 | 92.1 | 0.22 | 3.951 | 0.8693 | 25.4 |
| 0.70 | 0.3933 | 0.2753 | 88.8 | 0.20 | 4.441 | 0.8881 | 23.1 |
| 0.68 | 0.4420 | 0.3006 | 85.7 | 0.18 | 5.033 | 0.9059 | 20.7 |
| 0.66 | 0.4942 | 0.3262 | 82.6 | 0.16 | 5.766 | 0.9226 | 18.4 |
| 0.64 | 0.5501 | 0.3521 | 79.6 | 0.14 | 6.701 | 0.9381 | 16.1 |
| 0.62 | 0.6100 | 0.3782 | 76.6 | 0.12 | 7.936 | 0.9523 | 13.8 |
| 0.60 | 0.6742 | 0.4045 | 73.7 | 0.10 | 9.651 | 0.9651 | 11.5 |
| 0.58 | 0.7430 | 0.4309 | 70.9 | 0.08 | 12.203 | 0.9762 | 9.2 |
| 0.56 | 0.8168 | 0.4574 | 68.1 | 0.06 | 16.426 | 0.9856 | 6.9 |
| 0.54 | 0.8961 | 0.4839 | 65.4 | 0.04 | 24.82 | 0.9929 | 4.6 |
| 0.52 | 0.9815 | 0.5104 | 62.7 | 0.02 | 49.90 | 0.9980 | 2.3 |
| 0.50 | 1.0736 | 0.5363 | 60.0 | 0.00 | ∞ | 1.0000 | 0.0 |

FUEL INJECTION VALVE

The present invention relates to a fuel injection valve, in particular a fuel injection valve for cylinder injection of fuel wherein a fuel flow is injected from a fuel infection nozzle by giving vortex forming energy to the fuel flow by vortex forming means.

As a fuel injection valve which eddies a fuel and injects it, there have been known e.g. ones shown in FIG. 12 (JP-A-477150). Specifically, there have been known the one wherein a needle valve 1 has a circumferential surface formed with tangential grooves 4 as tangential channels as shown in FIG. 12 (A), the one wherein a vortex forming chamber 5 has tangential ports 6 tangentially communicated therewith as shown in FIG. 12 (B), and the one wherein a partition member 9 is arranged between an inner circumferential surface of a nozzle body 7 and an needle valve 1 and has an outer circumferential surface formed with tangential grooves 10. In any one of the fuel injection valves (A)–(C), a fuel is eddied by the tangential grooves or the tangential ports, and the fuel is atomized to form spray when it is injected from the fuel injection nozzle.

In the fuel injection valves wherein the fuel is injected in a vortex pattern, the needle valves have a leading edge formed in a conical shape as shown in FIG. 12. In particular, a fuel injection valve wherein a fuel is injected into a cylinder of an internal combustion engine has created a problem in that carbon particles or other materials which have been formed by combustion in the cylinder are deposited on the leading edge of a needle valve to prevent the fuel from freely flowing so as to cause a change in an injection form (atomizing angle or equality in atomizing) or a change in flow rate because the presence of a cavity formed in a fuel injection nozzle prevents the fuel from cleaning the leading edge of the needle valve.

It is an object of the present invention to solve the problem, and to provide a fuel injection valve, in particular a fuel injection valve for cylinder injection of fuel wherein a fuel is injected in a vortex pattern, and which is capable of avoiding disturbance in a fuel flow, a change in an injection form (atomizing angle or equality in atomizing) or a change in flow rate by preventing carbon particles or other materials from being deposited on a leading edge of a needle valve.

According to a first aspect of the present invention, there is provided a fuel injection valve comprising a fuel injection nozzle; a valve seat having the fuel injection nozzle formed therein; a needle valve for opening and closing the fuel injection nozzle by engaging with and disengaging from the valve seat; a seat portion where the needle valve and the valve seat contact each other; and vortex forming means for giving a vortex motion to a fuel entering the fuel injection nozzle, the vortex forming means provided upstream the seat portion; wherein the needle valve has a leading edge formed with a flat portion so as to expand in a direction perpendicular to an axis thereof.

According to a second aspect of the present invention, there is provided a fuel injection valve comprising a fuel injection nozzle; a valve seat having the fuel injection nozzle formed therein; a needle valve for opening and closing the fuel injection nozzle by engaging with and disengaging from the valve seat; a seat portion where the needle valve and the valve seat contact each other; and vortex forming means for giving a vortex motion to a fuel entering the fuel injection nozzle, the vortex forming means provided upstream the seat portion; wherein the needle valve has a leading edge formed with a flat portion so as to expand in a direction perpendicular to an axis thereof, wherein the valve seat is provided at an end of a hollow valve body, the needle valve is slidable in the valve body, the vortex forming means comprises a vortex forming member which is arranged so as to surround the needle valve and slidably support the needle valve, and the vortex forming member have outer peripheral surfaces, channel portions, an annular groove and vortex forming grooves formed thereon, the outer peripheral surfaces contacting an inner circumferential surface of the valve body to position the vortex forming member to the valve body, the channel portions formed between the outer peripheral surfaces to provide axial channels, the annular groove formed at an inner portion on an axial end surface of the vortex forming member facing the valve seat, and each of the vortex forming grooves having an end connected to a corresponding channel portion and the other end extended inwardly in a radial direction of the vortex forming member and in a direction tangent to the annular groove to be connected to the annular groove.

According to a third aspect of the present invention, the flat portion on the leading edge of the needle valve has a diameter not greater than a cavity diameter of a fuel flow formed in the fuel injection nozzle.

According to a fourth aspect of the present invention, that is provided a fuel injection valve comprising a fuel injection nozzle; a valve seat having the fuel injection nozzle formed therein; a needle valve for opening and closing the fuel injection nozzle by engaging with and disengaging from the valve seat; a seat portion where the needle valve and the valve seat contact each other; and vortex forming means for giving a vortex motion to a fuel entering the fuel injection nozzle, the vortex forming means provided upstream the seat portion; wherein the leading edge of the needle valve is formed in a conical shape having an apex angle of not less than 150°.

According to a fifth aspect of the present invention, the leading edge of the needle valve is plated.

The channel portions of the vortex forming member may comprise flat surfaces formed on a circumferential surface of the vortex forming member.

In accordance with the first and second aspects of the present invention, the leading edge of the needle valve can be formed in a flat shape to prevent carbon particles from adhering from a side of the fuel injection nozzle so as to give a free flow to the fuel in the injection nozzle and to avoid a change in an injection shape (atomizing angle or equality in atomizing) and flow rate.

In accordance with the third aspect of the present invention, the flat portion on the leading edge of the needle valve can have a diameter not greater than the cavity diameter of the fuel flow formed in the fuel injection nozzle to restrain a change in the vortex shape of the fuel which is caused by providing the leading edge of the needle valve with the flat portion.

In accordance with the fourth aspect of the present invention, the leading edge of the needle valve can be formed in a conical shape having an apex angle of not less than 150° to prevent carbon particles from adhering, offering advantages in that the fuel flow is free from adhering of the carbon particles in the nozzle, and that productivity is raised and cost is reduced.

In accordance with the fifth aspect of the present invention, the leading edge of the needle valve can be plated to prevent carbon particles or other materials from adhering.

In the drawings:

FIG. 9 is a table showing relationships among the cavity coefficient and the respective characteristics;

EMBODIMENT 1

Structure of Embodiment 1

Figure 1:
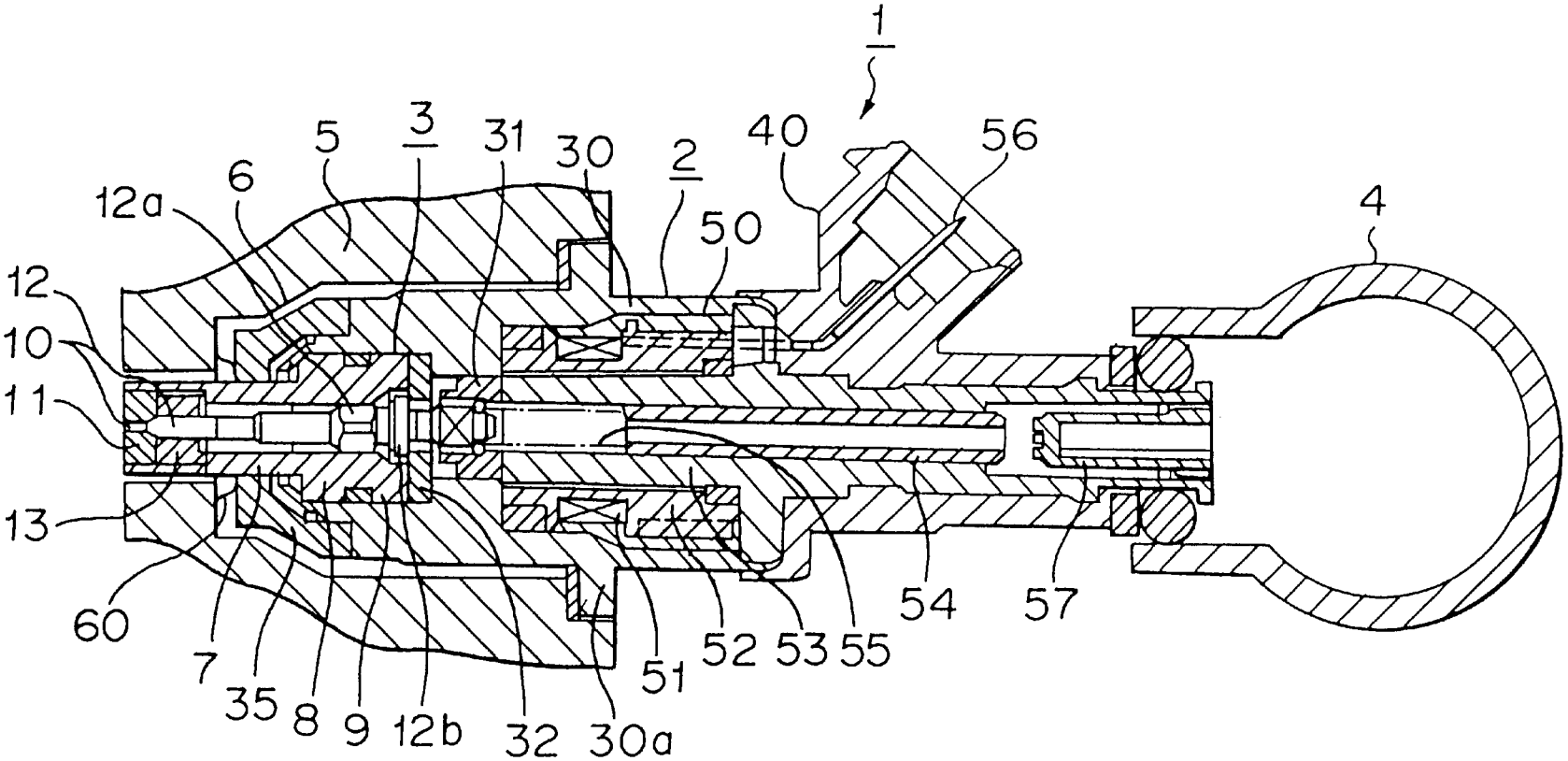
FIG. 1 is a sectional side elevation showing the entire structure of the fuel injection valve of cylinder injection of fuel according to a first embodiment of the present invention.

In FIG. 1, there is shown a sectional side elevation of the entire structure of a fuel injection valve 1 for cylinder injection of fuel according to a first embodiment of the present invention. The fuel injection valve 1 is constituted by a housing body 2, and a valve arrangement 3 fixed to an end of the housing body by e.g. caulking and covered with a holder 35. The housing body 2 has the other end connected to a fuel supply pipe 4, from which a fuel is supplied through a fuel filter 57 into the injection valve 1 under a high pressure. The injection valve 1 has a leading portion inserted into a fuel injection valve inserting hole 6 formed in a cylinder head 5 of an internal combustion engine, and has the leading portion attached in the insertion hole so as to be sealed with e.g. a wave washer 60.

The valve arrangement 3 includes a stepped cylindrical and hollow valve body 9 having a small diameter cylindrical portion 7 and a large diameter cylindrical portion 8, a valve seat 11 fixed to a leading end of a central hole in the valve body 9 and having a fuel injection nozzle 10, a needle valve 12 as a valve element which is engaged with and disengaged from the valve seat 11 by a solenoid arrangement 50 described later on to open and close the fuel injection nozzle 10, and a vortex forming member 13 for guiding the needle valve 12 in an axial direction of the needle valve and for giving a vortex motion to a fuel which flows into the fuel injection nozzle 10 in the valve seat 11 in an inwardly radial direction of the injection nozzle. The valve body 9 of the valve arrangement 3 forms a housing for the fuel injection valve 1 together with the housing body.

The housing body 2 includes a first housing 30 having a flange 30*a* for attaching the fuel injection valve 1 to the cylinder head 5, and a second housing 40 provided with the solenoid arrangement 50. The solenoid arrangement 50 includes a bobbin 52 with a coil 51 wound thereon, a core 53 arranged in an inner circumferential portion of the bobbin 52. The coil 51 is connected to a terminal 56. The core 53 is formed in a hollow and cylindrical shape so as to provide a fuel passage in it. In the hollow portion of the core, a spring 55 is extended between a sleeve 54 and an inner end of the needle valve 12.

The inner end of the needle valve 12 has a movable armature 31 attached thereto so as to face a leading end of the core 53. The needle valve 12 has an intermediate portion formed with a guide 12*a* for slidably guiding the valve 12 along an inner circumferential surface of the valve body 9, and a needle flange 12*b* for contacting with a spacer 32 arranged in the first housing 30.

Figure 2:
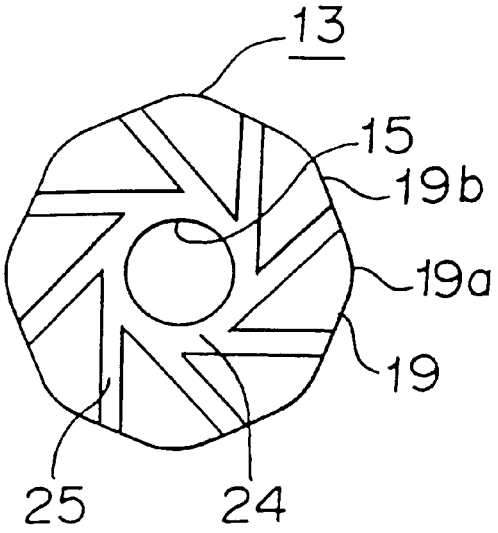
FIG. 2 is a front view of the vortex forming member according to the first embodiment as viewed from a side of the valve seat.
Figure 3:
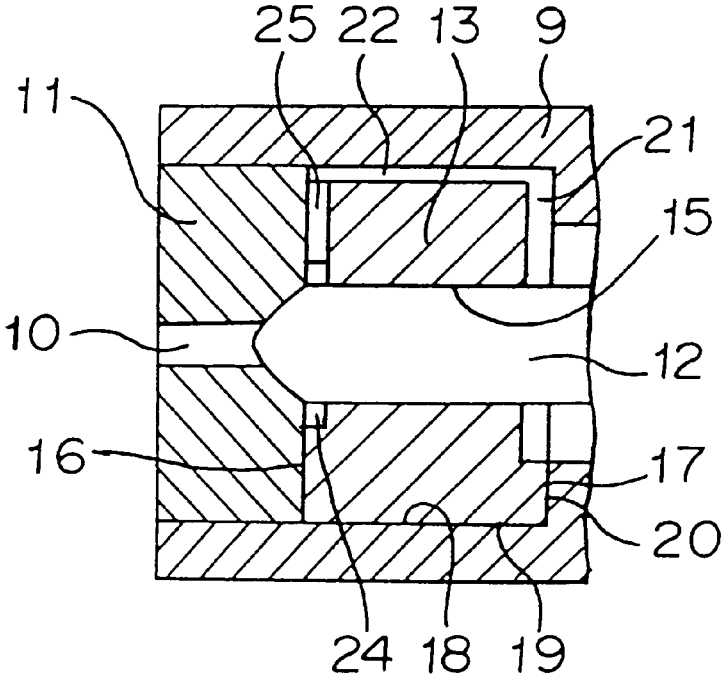
FIG. 3 is an enlarged sectional side elevation showing the needle valve and its surroundings according to the first embodiment.

In FIG. 2, there is shown a front view of the vortex forming member 13 as viewed from a side of the valve seat 11. In FIG. 3, there is shown an enlarged sectional side view of the valve and its surroundings in the valve arrangement 3. In these Figures, the vortex forming member 13 of the valve arrangement 3 includes a substantially cylindrical and hollow member which has a central portion formed with a central hole 15 so as to surround the needle valve 12 as a valve element and support it in a slidable way in an axial direction of the central hole. The vortex forming body includes a first end surface 16 which contacts with the valve seat 11 when the vortex forming body is assembled into the valve arrangement 3, a second end surface 17 remote from the valve seat 11, and an outer circumferential surface 19 which extends between the first and second end surfaces and which has portions contacted with the inner circumferential surface 18 of the valve body 9 as a part of the hollow housing.

The second end surface 17 of the vortex forming member 13 has a peripheral portion contacted with and supported by a shoulder 20 of the inner circumferential surface 18 of the valve body 9. The second end surface has grooves 21 formed thereon so as to extend in radial directions, allowing the fuel to flow from an inner circumferential portion of the second end surface 17 into an outer circumferential portion of the second end surface.

The outer circumferential surface 19 of the vortex forming member 13 is constituted by a plurality of flat surfaces which are separated at equal intervals in a circumferential direction and extend in the axial direction. As a result, the outer circumferential surface 19 is constituted by outer peripheral surfaces 19*a* for contacting the inner circumferential surface 18 of the valve body 9 to position the vortex member to the valve body 9, and channel portions 19*b* which are flat surfaces formed between the outer peripheral surfaces to provide axial channels 22 for the fuel along with the inner circumferential surface 18. The axial channels 22 are spaces which are defined by the inner circumferential surfaces 18 of the valve body 9 and the flat channel portions 19*b*, and which are formed in a plano-convex lens shape in section. Although the number of the axial channels 22 is 8 in the shown example, the number may be 4, 6 or a suitable number greater than 6.

On the first end surface 16 of the vortex forming member 13, namely the axial end surface of the vortex forming member facing the valve seat 11, are provided an annular groove 24 which is formed around the central hole 15 of the first end surface 16 and has a predetermined width. On the first end surface are also provided vortex forming grooves 25, each of which has one end connected to a corresponding channel portion 19*b* of the circumferential surface 19 and inwardly extended in a substantially radial direction and the other end tangentially connected to the annular groove 24. Although the vortex forming grooves 25 have the same width as the annular groove 24 in the shown example, the vortex forming grooves may have a different width as long as the outer edge of each of the vortex forming grooves 24 is tangentially connected to the outer edge of the annular groove 24. Although the number of the vortex forming grooves 25 is 8 in the shown example, the number may be 4, 6 or a suitable number greater than 6.

Figure 4:
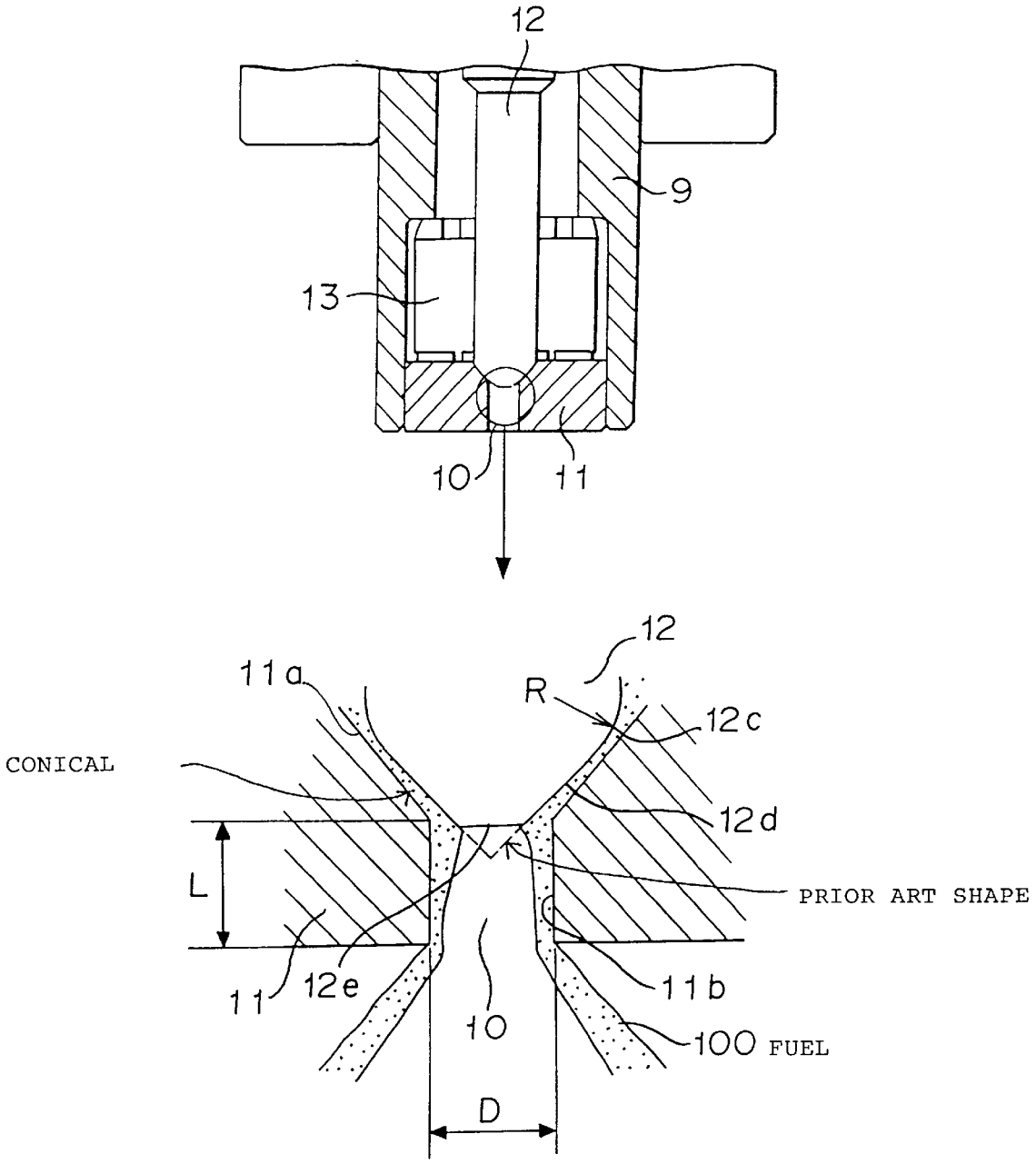
FIG. 4 are enlarged sectional side elevations showing the shape of a leading edge of the needle valve, and a fuel injection nozzle and its surroundings according to the first embodiment.

In FIG. 4, there is shown an enlarged sectional view of the shape of a leading edge of the needle valve 12, and the injection nozzle 10 and its surroundings. In this Figure, the leading edge of the needle valve 12 is formed with a seat portion 12*c* having a radius and contacting with the valve seat 11, a conical portion 12*d* extending from the seat portion 12*c* towards the leading edge, and a flat portion 12*e* provided by cutting out a leading edge of the conical portion 12*d* in a direction substantially perpendicular to the nozzle 10. The conical portion 12*d* and the flat portion 12*e* of the needle valve 12 may have a connecting portion therebetween formed with a minute radius. On the valve seat 11 a conical portion 11*a* is provided with a seat portion which engages with and disengages from the needle valve 12, and an injecting portion 11*b* which provides the injection hole 10 in a substantially cylindrical shape having a length L and a diameter D. In FIG. 4, dotted lines indicate the shape of the leading edge of the conventional needle valve 12, and reference numeral 100 designates an injecting shape of the fuel.

Operation of Embodiment 1

Now, the operation of the fuel injection valve according to the first embodiment will be explained. Referring to FIG. 1, the coil 51 of the solenoid arrangement 50 is energized through the terminal 56 from externally, a magnetic path constituted by the movable armature 31, the core 53 and the housing body 2 has magnetic flux generated therein, and the movable armature 31 is attracted toward the core 53 against the elastic force of the spring 55. The needle valve 12 integral with the movable armature 31 is moved in a direction opposite to the valve seat by a predetermined stroke until the needle flange 12*b* contacts with the spacer 32. The needle valve 12 is guided along and supported by the inner circumferential surface of the valve body 9 through the guide 12*a*.

Referring now to FIGS. 2 and 3, the leading edge of the needle valve 12 is disengaged from the valve seat 11 to form a gap, the fuel which is introduced from the fuel supply pipe 4 under a high pressure flows into the axial channels 22 around the vortex forming member 13 from a passage between the valve body 9 and the needle valve 12 through the grooves 21 on the second end surface 17 of the vortex forming member. Then, the fuel flows into the vortex forming grooves 25 on the first end surface 16 of the vortex forming member 13, flows inwardly in radial directions, and flows into the annular groove 24 on the first end surface 16 in directions tangential to the annular groove to form vortices. After that, the fuel passes through the injection nozzle 10 in the valve seat 11 and is atomized from an outlet of the nozzle.

During such process, the fuel flows into the annular groove 24 from the vortex forming grooves 25 in a rapid and smooth manner in the tangential directions with respect to the annular groove 24. As a result, a pluarity of jets of the fuel from the vortex forming grooves 25 can be prevented from colliding with one other, and a newly added jet of the fuel can be prevented from colliding with jets of the fuel already formed. Thus, the flows of the fuel are smooth and free from great pressure loss due to collision in the flows or turbulence in the flows.

Consequently, the fuel is given a vortex force by the vortex forming member 13 to be injected as vortices into the injection nozzle 10, and a total fuel flow 100 takes an injection shape having a cavity in the nozzle 10 as shown in FIG. 4. If the leading edge of the needle valve 12 is formed in a conical shape as indicated by the dotted lines in FIG. 4, a surface area for the leading edge for explosure to the cavity in the fuel flow becomes greater to introduce easy adhesion of carbon particles, engine oil, moisture and the like (mainly carbon particles) generated in the engine cylinder. In order to cope with this problem, the leading edge of the needle valve 12 can be formed in the planar shape 12*e* in accordance with first embodiment as shown in FIG. 4 to minimize the surface area of the leading edge for exposure to the cavity in the fuel flow so as to lessen an area where carbon particles or other materials can adhere. Such arrangement can also offer an advantage in that even if carbon particles or other materials have adhered on a portion with the planar shape 12*e* formed thereon, the fuel flow 100 is hardly adversely affected.

EMBODIMENT 2

Figure 5:
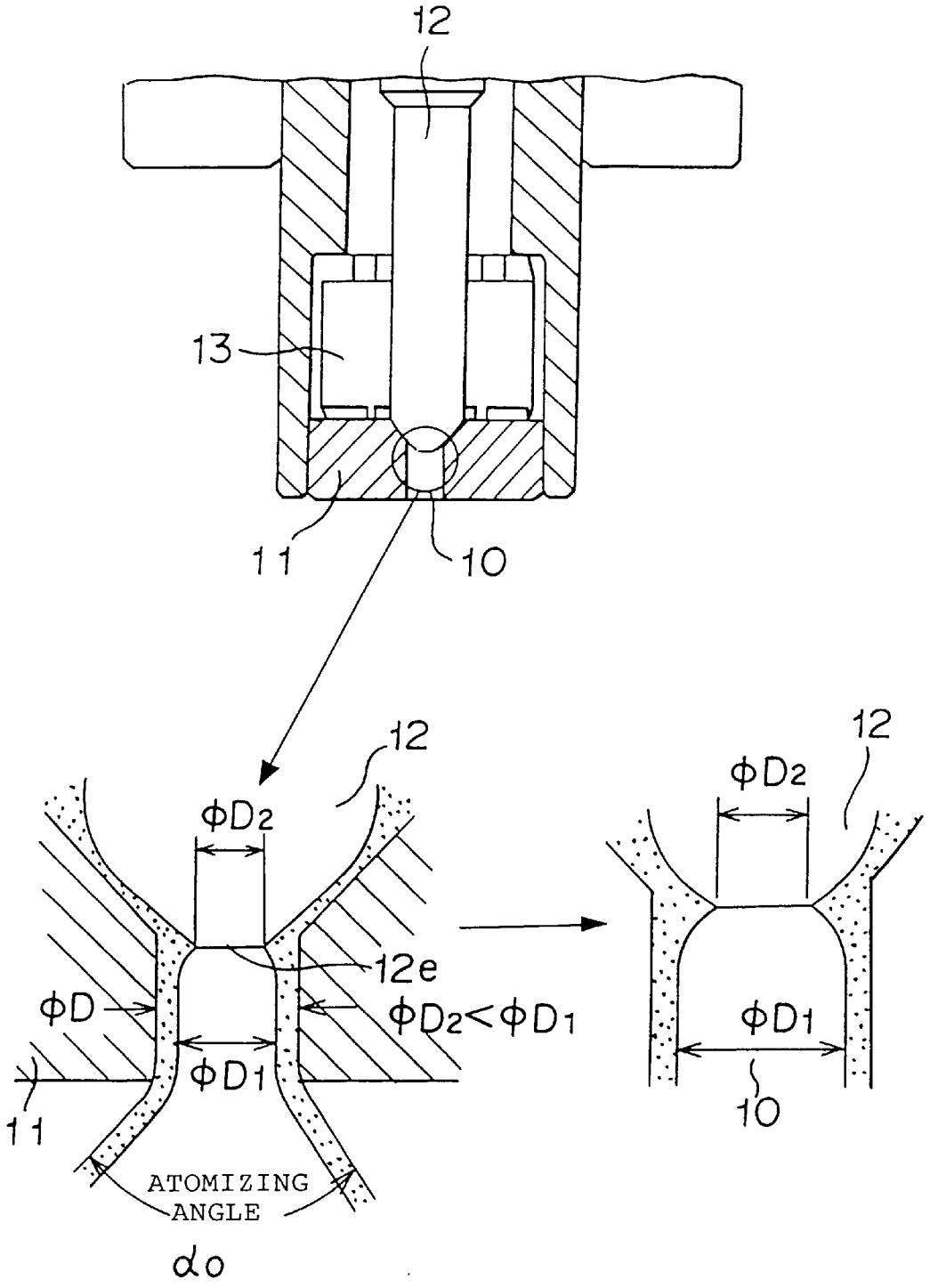
FIG. 5 are enlarged sectional side elevations showing the shape of a leading edge of the needle valve, and a fuel injection nozzle and its surroundings according to a second embodiment.

In FIG. 5, there are shown enlarged sectional views of the shape of a leading edge of the needle valve 12, and the injection nozzle 10 and its surroundings according to a second embodiment. In this embodiment, the diameter $D_2$ of the planar shape 12*e* on the leading edge of the needle valve 12 is set to be not greater than the diameter D1 of the cavity in the injected fuel within the nozzle 10, preventing the planar shape 12*e* on the leading edge of the needle valve 12 from having effect on the fuel flow.

The cavity diameter in the fuel vortex within the nozzle 10 can be found in accordance with e.g. the following method. The cavity diameter may be found by producing an actual product and carrying out an experiment/simulation on the actual product.

Figure 6:
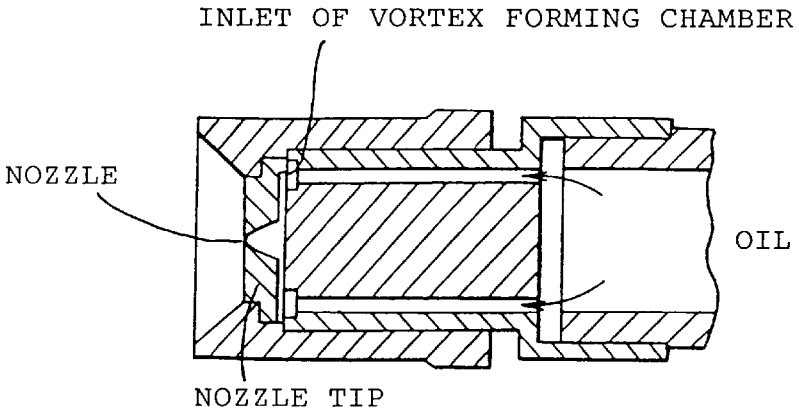
FIG. 6 is a schematic diagram showing a basic nozzle model for analyzing the flow state in an vortex forming chamber of an vortex injection nozzle.

According to Transactions of the Japan Society of Mechanical Engineers, 17-58(1951), Burning Appliance Engineering (published by the Nikkan Kogyo Shinbun), Messrs. Tanasawa and Marshall have analyzed the flowing state in a vortex forming chamber in a vortex forming injection nozzle shown in FIG. 6 to find relationships among the sizes of the vortex forming chamber, flow coefficients and atomizing angles. FIG. 6 shows a basic nozzle as a model, and FIG. 7 shows the energy distribution in the vortex forming chamber.

Figure 7:
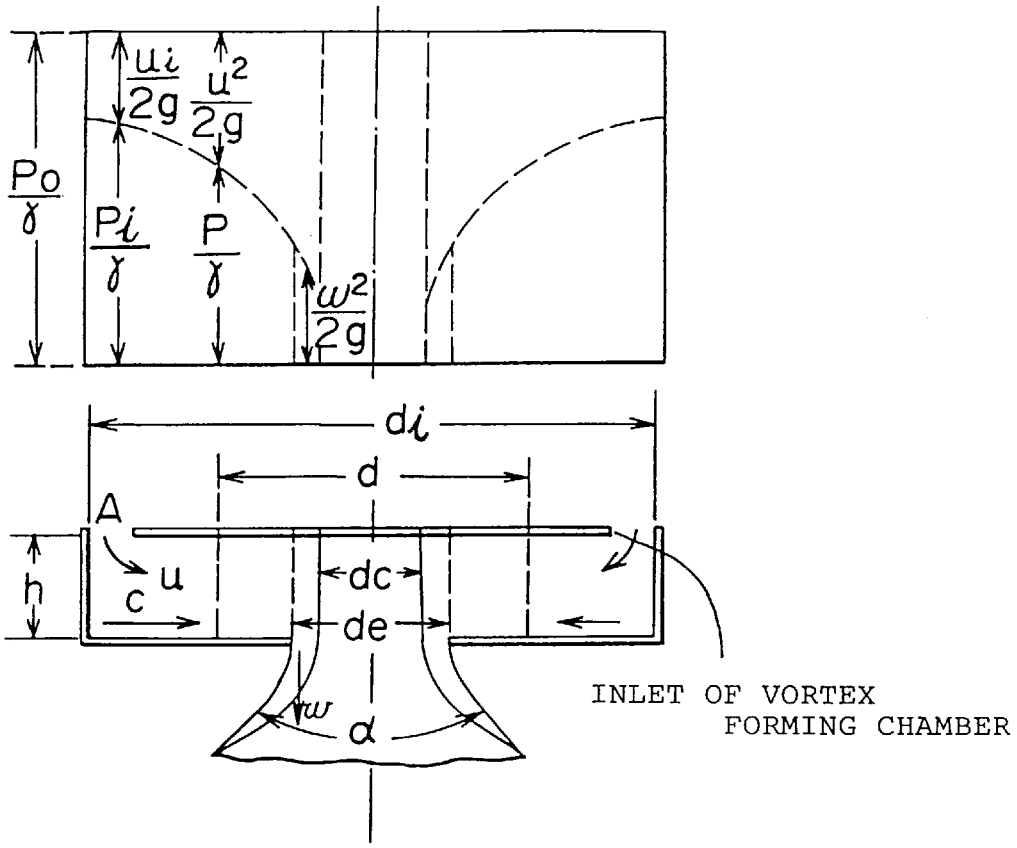
FIG. 7 are diagrams showing an energy distribution in the vortex forming chamber of FIG. 6.

If the difference between ambient pressure and the liquid pressure before entry into the vortex forming chamber is defined as $p_0$ and the specific weight of liquid is defined as r in FIG. 7, the inlet of the vortex forming chamber has a pressure of $p_i$ and a tangential speed of $u_i$ after the liquid has passed through tangential passages. Since the free vortex law is established in the vortex forming chamber and the degree of vortex is constant at every portion, the equation, $u \cdot d = u_i \cdot d_i$=constant, is obtained. The reference u represents the tangential speed (m/s) with respect to an arbitrary diameter, the reference d represents an arbitrary diameter (m), the reference $u_i$ represents the tangential speed (m/s) at the inlet of the vortex forming chamber, and the reference $d_i$ represents the outer diameter (m) of the vortex forming chamber. Although the remainder which is obtained by subtracting tangential speed energy $u^2/2$ g from total energy $p_0/r$ is pressure energy p/r and radius speed energy $v^2/2$ g, $v^2/2$ g may be eliminated if the height of the vortex forming chamber is great.

Since the cavity is formed at a central portion of the nozzle, the total energy $p_0/r$ is changed to the tangential speed energy $u_2^c/2$ g in an annular flow with the liquid residing therein (the inner diameter d of the annular flow is equal to $d_c$). Flow rate Q is represented by the equation (1) because the flow rate entering the vortex forming chamber is equal to the flow rate injecting from the nozzle. In the equation (1), the reference Q represents flow rate ($m^2/s$), the reference w represents axial speed (m/s), the reference r represents an arbitrary diameter (m), the reference $A_i$ represents the area of the vortex forming chamber inlet ($m^2$), the reference $d_e$ represents the diameter of the nozzle (m), and the reference $d_c$ represents the inner diameter (m) of the annular liquid flow in the nozzle.

The equation (2) is established according to the Bernoulli's theorem and the free vortex law. Substituting the equation (2) in the equation (1), the equation (3) is obtained. Flow coefficient $C_0$ is represented by the equation (4). There is a relationship defined by the equation (5) between $u_i$ and $d_c$. The cavity diameter $d_c$ can be found according to the equations (1)–(5). The parameter representing the characteristics of the vortex forming chamber is defined as K found according to the equation (6), and k ($k=d_c/d_e$) is called cavity coefficient.

$$Q = \int_{d_{c/2}}^{d_{e/2}} \omega 2\pi r dr = u_i A_i \tag{1}$$

$$\frac{\omega^2}{2g} + \frac{u^2}{2g} = \frac{u_c^2}{2g} = \frac{p_o}{r} \tag{2}$$

$$Q = C_0 \pi \left(\frac{d_e}{2}\right)^2 \left(\frac{2gp_o}{r}\right)^{0.5} \tag{3}$$

$$C_0 = \left\{1 - \left(\frac{d_c}{d_e}\right)^2\right\}^{0.5} - \left(\frac{d_c}{d_e}\right)^2 \ln\left[\frac{d_e}{d_c} + \left\{\left(\frac{d_e}{d_c}\right)^2 - 1\right\}^{0.5}\right] \tag{4}$$

$$u_i = \left(\frac{d_c}{d_i}\right)\left(\frac{2gp_o}{r}\right)^{0.5} \tag{5}$$

$$K = \left(\frac{4A_i}{\pi d_e^2}\right)\left(\frac{d_e}{d_i}\right) = \frac{4A_i}{\pi d_e \cdot d_i} \tag{6}$$

Figure 8:
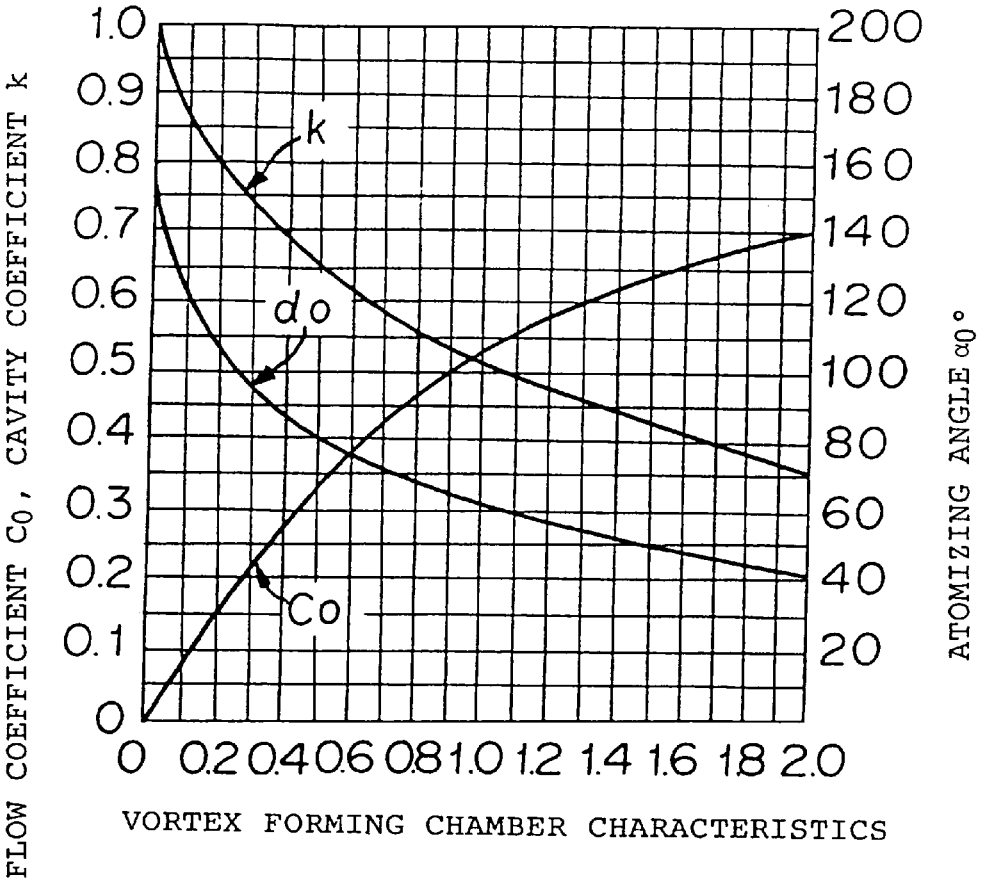
FIG. 8 is a graph showing relationships among flow coefficient, cavity coefficient and characteristics with respect to the vortex forming chamber.

Since cavity coefficient k and flow coefficient $C_0$ can be found according to these equations if K which is related only to the sizes of the vortex forming chamber is specified, K is named vortex forming chamber characteristics, and k and $C_0$ are shown in FIGS. 8 and 9. The characteristics K is a dimensionless number which is related to the area of a vortex forming chamber inlet and the area of an injection hole. If the characteristic K is small, it is meant that the area of the inlet is small and the area of an outlet is large. In such a case, the cavity is great, and the vortex speed becomes larger in comparison with the axial speed, decreasing the flow coefficient in comparison with other injection valves.

An atomizing angle $\alpha_0$ can be represented by the following equation (7), and values indicative of $\alpha_0$ are shown in FIGS. 8 and 9.

$$\alpha_0 = 2\tan^{-1}\left\{\frac{k}{(1-k^2)^{0.5}}\right\} \tag{7}$$

This theory is applicable to a case wherein the flow is a potential flow and ideal in terms of sizes. In order to apply this theory to an actual product, some corrections are required, taking various factors into account.

In order that the diameter D2 of the flat shape portion 12*e* on the leading end of the needle valve 12 is set to be not greater than the cavity diameter D1 of a fuel flow within the injection nozzle 10 in accordance with the method explained above, if the atomizing $\alpha_0$ is a value of 60° and the diameter of the injection nozzle 10 is 1 mm, the diameter of the flat shape portion 12*e* on the leading end of the needle valve 12 is set to not greater than 0.5 mm because the cavity coefficient k is 0.5 and the cavity diameter of the vortex flow is 0.5 mm according to FIGS. 8 and 9.

Figure 10:
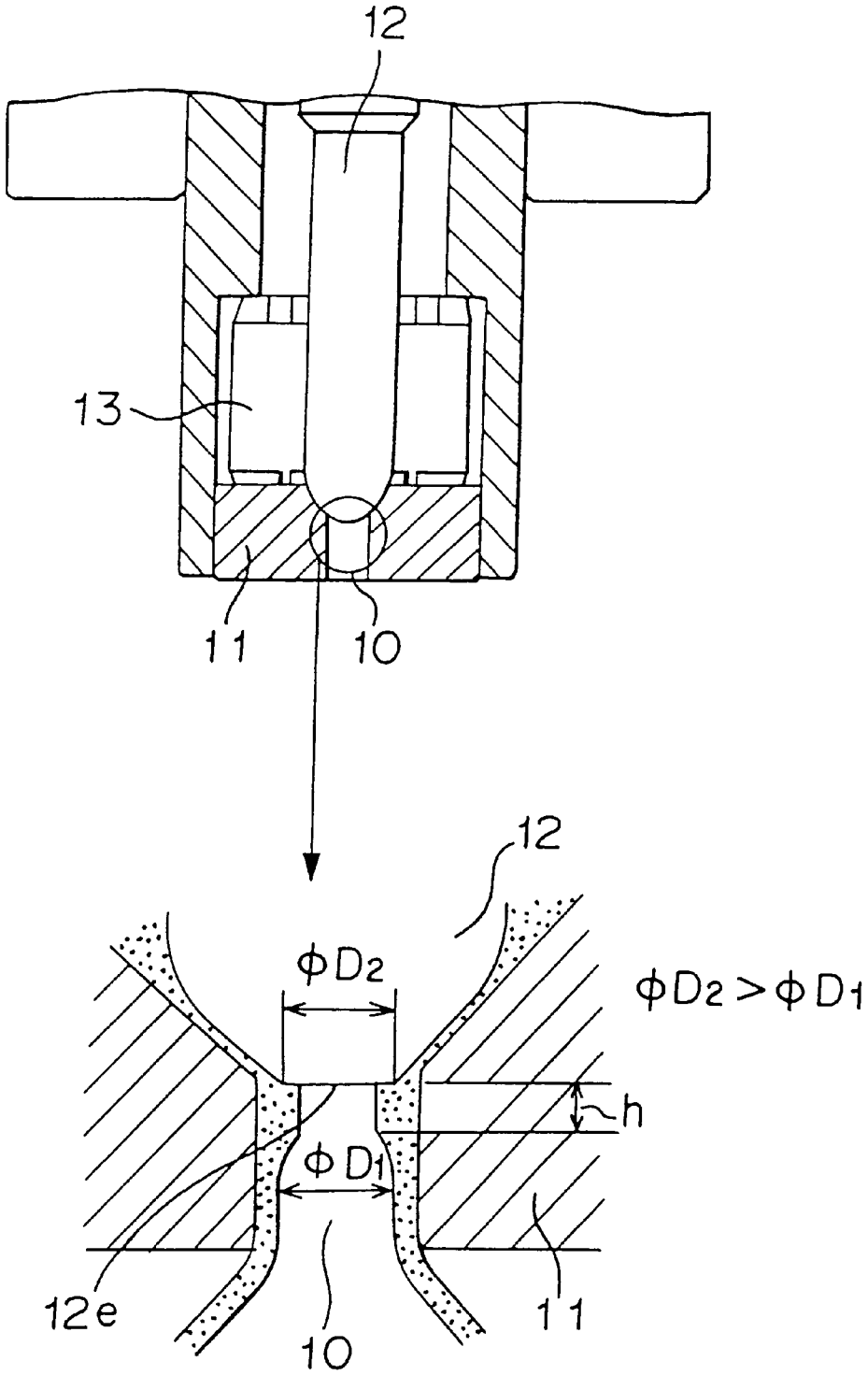
FIG. 10 are enlarged sectional side elevations showing the shape of a leading edge of the needle valve, and the fuel injection nozzle and its surroundings, which are presented as an example to be contrasted with the second embodiment.

In FIG. 10, there is shown a case which is contrasted with the second embodiment wherein the diameter D2 of the flat shape portion 12*e* on the leading edge of the needle valve 12 is greater than the cavity diameter D1 of the vortex in the injection nozzle 10. In this case, the cavity has a smaller diameter portion created therein downstream the flat shape portion 12*e* on the leading edge of the needle valve 12, giving a change in the fuel flow within the injection nozzle 10. Since the degree of a change in the fuel flow varies on the diameter of the flat shape portion 12*e* on the leading edge of the needle valve 12, variations in the performance of fuel injection valves are enlarged. If carbon particles adhere on the flat shape portion 12*e*, the fuel flow is further adversely affected to be prevented from obtaining a desired injection shape.

According to the second embodiment, the diameter of the flat shape portion on the leading edge of the needle valve can be set to be not greater than the cavity diameter in the injection nozzle, preventing the provision of the flat shape portion from changing the fuel flow.

EMBODIMENT 3

Figure 11:
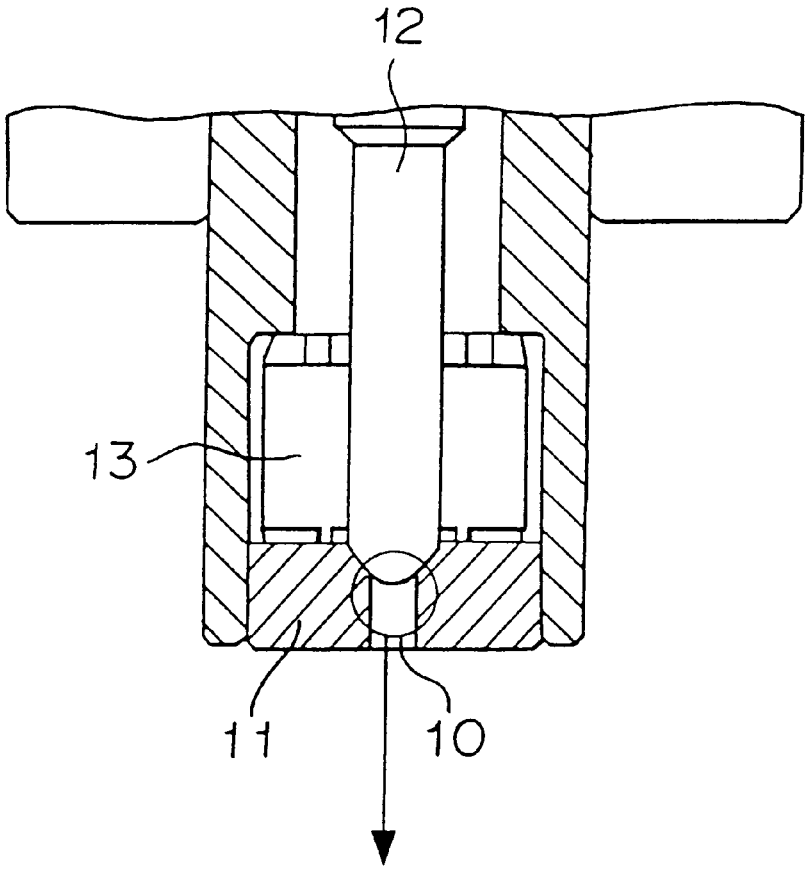
FIG. 11 are enlarged sectional side elevations showing the shape of a leading edge of the needle valve, and a fuel injection nozzle and its surroundings according to a third embodiment.
Figure 11:
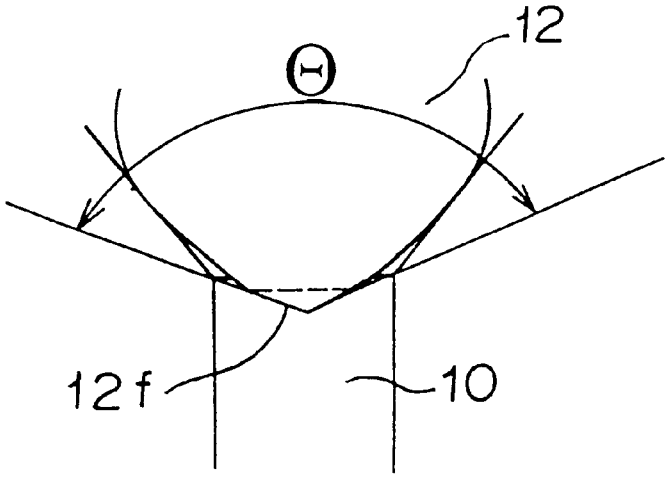

In FIG. 11, there are shown enlarged sectional views of the shape of a leading edge of the needle valve, and the injection nozzle 10 and its surroundings according to a third embodiment. In this embodiment, the leading end of the needle valve 12 is formed with a conical shaped portion 12*f* which has an apex angle Θ of not less than 150° instead of the provision of the flat shape.

This embodiment can offer advantages in that carbon particles or other materials can be prevented from adhering, that the fuel flow in the injection nozzle 10 can be prevented from being adversely affected like the second embodiment, and that productivity is increased and cost is reduced.

EMBODIMENT 4

A fourth embodiment is different from the first and the third embodiments in that the leading edge of the needle valve 12 is plated. It is preferable that an area to be plated includes the flat shaped portion 12*e* according to the first and second embodiments or the conical shaped portion 12*f* according to third embodiments and a portion which is inside the seat diameter of the seat portion with the needles valve 12 and the valve seat 11 contacted thereon. As plating of the leading edge of the needle valve, chrome plating, or plating with fluorocarbon polymer included in nickel is preferable.

According to the fourth embodiment, the surface including the leading edge of the needle valve 12 can be plated to prevent carbon particles or other materials from adhering.

OTHER EMBODIMENT

Figure 12:
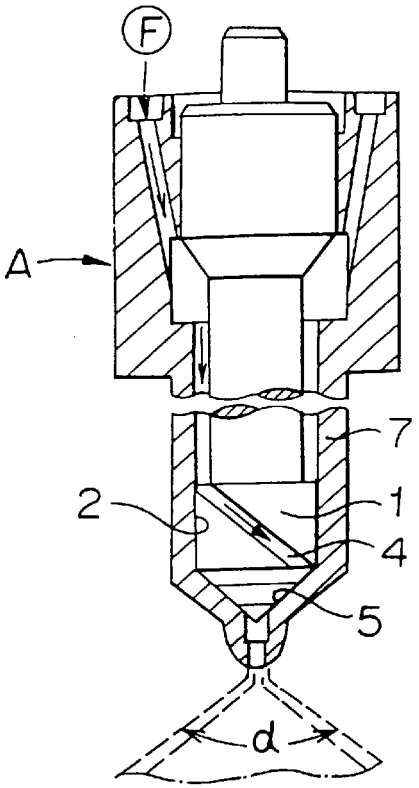
FIGURE 12 (A) PRIOR ART
FIGS. 12A–12C are section side elevations showing the structure of conventional fuel injection nozzles.
Figure 12:
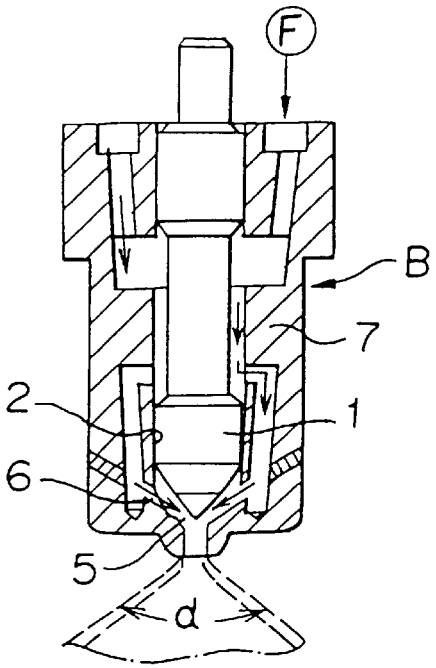
FIGURE 12 (B) PRIOR ART
Figure 12:
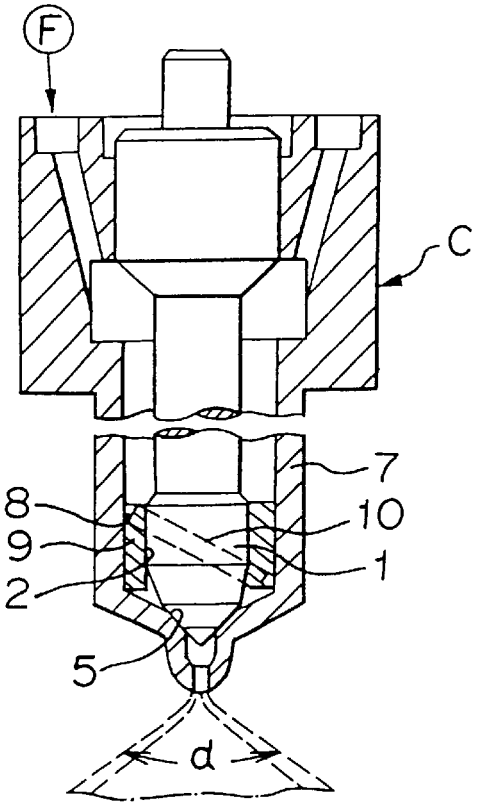
FIGURE 12 (C) PRIOR ART

Although explanation of the embodiments stated earlier has been made with respect to the fuel injection valves having the structure shown in FIG. 1 as a fuel injection valve for eddying a fuel and injecting it, the provision of the flat shape on the leading edge of the needle valve 1 may be carried out in the fuel injection valve wherein the needle valve 1 has a circumferential surface formed with the tangential grooves 4 as tangential channels as shown in FIG. 12 (A), the fuel injection valve wherein the vortex forming chamber has the tangential ports 6 tangentially communicated therewith as shown in FIG. 12 (B), or the fuel injection valve wherein the partition member 9 is arranged between the inner circumferential surface of the nozzle body 7 and the needle valve 1 and the partition member has a circumferential surface formed with the tangential grooves 10.

What is claimed is:

1. A fuel injection valve, comprising:

a fuel injection nozzle;

a valve seat having the fuel injection nozzle formed therein;

a needle valve for opening and closing the fuel injection nozzle by engaging with and disengaging from the valve seat;

a seat portion where the needle valve and the valve seat contact each other; and a vortex forming member for giving a vortex motion to a fuel entering the fuel injection nozzle, the vortex forming member provided upstream the seat portion, wherein the needle valve has a leading shape formed with a flat portion so as to expand in a direction perpendicular to an axis thereof, or formed in a conical shape having an apex angle of not less than 150°.

2. A fuel injection valve according to claim 1, wherein the flat portion on the leading edge of the needle valve has a diameter not greater than a cavity diameter of a fuel flow formed in the fuel injection nozzle.

3. A fuel injection valve according to claim 1, wherein the leading edge of the needle valve is plated.

4. A fuel injection valve, comprising:

a fuel injection nozzle;

a valve seat having the fuel injection nozzle formed therein;

a needle valve for opening and closing the fuel injection nozzle by engaging with and disengaging from the valve seat;

a seat portion where the needle valve and the valve seat contact each other; and a vortex forming member for giving a vortex motion to a fuel entering the fuel injection nozzle, the vortex forming member provided upstream the seat portion;

wherein the needle valve has a leading edge formed with a flat portion so as to expand in a direction perpendicular to an axis thereof, or formed in a conical shape having an apex angle of not less than 150°;

wherein the valve seat is provided at an end of a hollow valve body, the needle valve is slidable in the valve body, and the vortex forming member comprises a vortex forming body with is arranged so as to surround the needle valve and slidably support the needle valve; and wherein the vortex forming body has outer peripheral surfaces, channel portions, an annular groove and vortex forming grooves formed thereon, the outer peripheral surfaces contacting an inner circumferential surface of the valve body to position the vortex forming body to the valve body, the channel portions formed between the outer peripheral surfaces to provide axial channels, the annular groove formed at an inner portion on an axial end surface of the vortex forming grooves having an end connected to a corresponding channel portion and the other end extended inwardly in a radial direction of the vortex forming body and in a direction tangent to the annular groove to be connected to the annular groove.

5. A fuel injection valve according to claim 4, wherein the channel portions of the vortex forming body comprise flat surfaces formed on an outer circumferential surface of the vortex forming body.

* * * * *